US006951405B2

(12) United States Patent
Yao

(10) Patent No.: US 6,951,405 B2
(45) Date of Patent: Oct. 4, 2005

(54) DECORATIVE LIGHT STRINGS WITH COMBINATIVE TREE

(75) Inventor: Joseph Yao, Taipei (TW)

(73) Assignee: Willis Electric Co., Ltd., Hsin-Chu (TW)

( * ) Notice: Subject to any disclaimer, the term of this patent is extended or adjusted under 35 U.S.C. 154(b) by 12 days.

(21) Appl. No.: 10/677,902

(22) Filed: Oct. 2, 2003

(65) Prior Publication Data

US 2004/0179353 A1 Sep. 16, 2004

(30) Foreign Application Priority Data

Mar. 11, 2003 (CN) ..... 03238505 U

(51) Int. Cl.[7] ..... F21S 6/00; A47G 33/06

(52) U.S. Cl. ..... 362/123; 362/413; 362/252; 428/20

(58) Field of Search ..... 362/123, 413, 362/252, 450; 428/20, 18–19

(56) References Cited

U.S. PATENT DOCUMENTS

| | | | | | |
|---|---|---|---|---|---|
| 1,656,148 | A | * | 1/1928 | Harris | 362/123 |
| 4,496,615 | A | * | 1/1985 | Huang | 428/9 |
| 5,342,661 | A | * | 8/1994 | Wilcox, II | 428/18 |
| 5,568,966 | A | * | 10/1996 | Miller et al. | 362/252 |
| 5,776,559 | A | * | 7/1998 | Woolford | 428/18 |
| 6,030,670 | A | * | 2/2000 | Chang | 428/19 |
| RE36,640 | E | * | 4/2000 | Frost et al. | 248/528 |

* cited by examiner

*Primary Examiner*—Ali Alavi
(74) *Attorney, Agent, or Firm*—McGlew and Tuttle, P.C.

(57) ABSTRACT

The present invention relates to a kind of decorative light strings with combination tree, including a long trunk to be composed of many short pipes, the height of tree lamp can be adjustable by the number of the short pipe; base frame is to use a support surface to erect the base frame and has a center axis to support long trunk to stand up right straight; multiple branches connect with the long trunk; single or multiple set of light strings, composed of many lamp bulbs, lamp holders, electrical conductors and receptacles, to be fixed on the branches to establish tree light strings.

20 Claims, 5 Drawing Sheets

DECORATIVE LIGHT STRINGS WITH COMBINATIVE TREE

FIELD OF THE INVENTION

The present invention relates to a combinative tree with decorative light strings.

BACKGROUND OF THE INVENTION

A conventional lamp light string set in a Christmas light string consists of a lamp bulb, lamp base, lamp holder, multiple electrical conductors, receptacles and/or flasher control. The electrical conductors can be single, double or more wires wound into an electrical circuit.

The distributed conductors can be formed by one, two or more than two electrical conductors, such as provided in the FIG. 4 of the U.S. Pat. No. 4,241,387 and the FIGS. 1 and 2 of the prior art in this case.

In general, the exemplary electrical conductors are wound in a tree. However, winding and unwinding can be troublesome and monotonous.

Furthermore, such winding and unwinding could lead to tangled up wire cradle after being used for several years. The present invention is an improvement over the problems of the conventional products.

SUMMARY OF THE INVENTION

Therefore, it is the objective of the present invention to use artificial trunks and branches of a decorative tree to provide a set of decorative light strings along with the electrical connectors wound on the tree itself. This way, the decorative light strings and branches of the tree form a shape so as to obtain a decorative effect.

The objective of the present invention is to make a conventional Christmas light strings package that is easy to transport and to improve on the defects of the conventional products, thereby avoiding unnecessary winding and unwinding of the product.

The present invention achieves those objectives by providing a set of decorative light strings on a combinative tree, including a long trunk to be composed of many short pipes, where the height of tree lamp can be adjusted by a number of short pipes.

The base frame uses a supporting surface to erect the base frame itself and has a center axle to support a long trunk to stand up right and straight.

A set of multiple branches connect with the long trunk, where single or multiple sets of light strings, composed of many lamp bulbs, lamp holders, electrical conductors and receptacles, are fixed on the branches to establish tree light strings.

The present invention provides a decorative light strings with combination tree and its characteristic by using the long trunk where the long trunk is composed of many hollow short pipes connected with each other.

The present invention also provides for a set of decorative light strings with combinative tree and its characteristic is to use the short hollow pipes to be manufactured by metal. The present invention is to provide decorative light strings with combination tree and its characteristic is to use the hollow short pipes having tenon for the convenience to fix it.

The object of the present invention is to provide a set of decorative light strings with combinative tree where its characteristic is an outer rim of one end of the short pipes at the predetermined distance of the open end having a flange. Another end has a predetermined length of L-indentation from the open end extending and matching the position of the flange. From the end having the flange, said flange is to aim at the open end of the L-indentation of another short pipe, to fit into the right position, then to rotate it to L-tail and to fix it tightly.

The present invention is to provide decorative light strings with combinative tree and its characteristic is to use the base part of L-indentation of the short pipe having an enlarge area so that the flange can be dovetailed into the enlarged area so as not to upside down and depart.

The present invention is to provide decorative light strings with combinative tree and its characteristic is the short pipes on the long trunk providing with one or more connecting rings to connect with many branches.

The present invention is to provide decorative light strings with combinative tree and its characteristic is the base from to be composed of many branch frames. It is able to stretch out or to fold up from the center axle.

The present invention is to provide decorative light strings with combinative tree and its characteristic is the base part of branch frame having fastening ring. The pin is going through said fastening ring to nail into supporting surface and fix the base frame.

The present invention is to provide decorative light strings with combinative tree and its characteristic is the base frame to be stretched out from the center axle and base frame will not fall on a certain angle of supporting surface.

The present invention is to provide decorative light strings with combinative tree and its characteristic is the support surface used to erect the base frame able to be indoor and out door floor.

The present invention is to provide decorative light strings with combinative tree and its characteristic is the support surface used to erect the base frame able to be soften and hard floors at out door.

The present invention is to provide decorative light strings with combinative tree and its characteristic is to provide the hollow short pipe between the long trunk and base frame. Said hollow short pipe did not attach with branch and light string to increase the distance between this light string and supporting surface.

The present invention is to provide decorative light strings with combinative tree and its characteristic is to use light string having the protection device, transformer or functional control device to increase the decorative function.

The present invention relates to decorative light strings with combinative tree. It is another kind of decorative light strings with combinative tree including a long trunk to be composed of many short pipes, the height of tree lamp can be adjustable by the number of the short pipe; an outer rim of one end of the hollow short pipes at the predetermined distance of the open end having a flange. Another end has a predetermined length of L-indentation from the open end extending and matching the position of the flange. From the end having the flange, said flange is to aim at the open end of the L-indentation of another short pipe, to fit into the right position, then to rotate it to L-tail and to fix it tightly; base frame is to use a supporting surface to erect the base frame and has a center axle to support long trunk to stand up right straight; multiple branches connect with the long trunk; single or multiple sets of light strings, composed of many lamp bulbs, lamp holders, electrical conductors and receptacles, to be fixed on the branches to establish tree light strings.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 2:
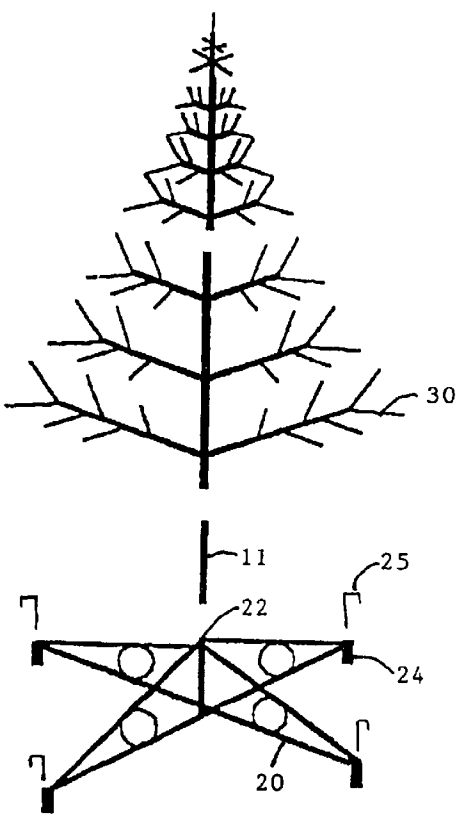
FIG. 2 is a perspective view of the preferred embodiment of the connection style of the decorative light strings with combinative tree of the present invention.

Referring to the drawings in particular, For the convenience of the description, the same composing part is to show the same number in the drawings.

Figure 1:
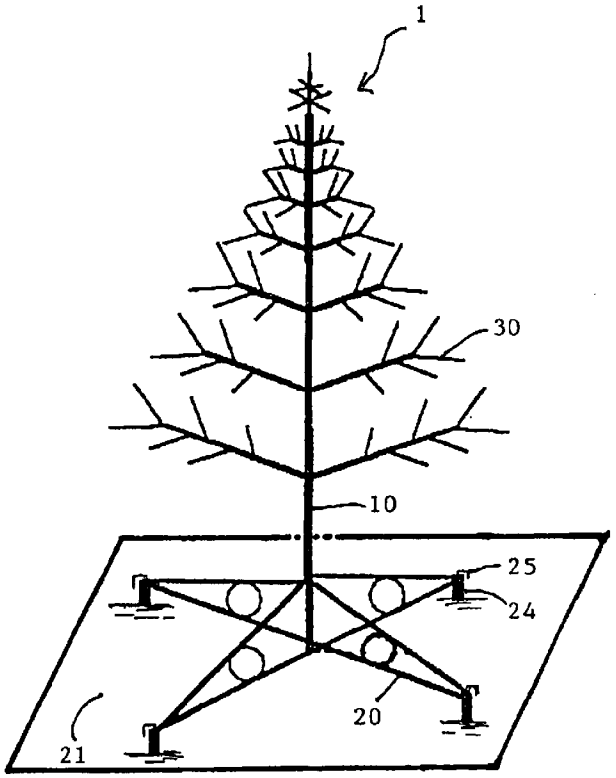
FIG. 1 is a perspective view with 3-dimention of decorative light strings with combinative tree of the present invention.

Now, referring to FIG. 1, it is a perspective view of the decorative light strings with combinative tree of the present invention. The structure of this combinative tree 1 includes a supporting surface 2T, a base frame 20, a long trunk 10 (and multiple branches 30; r the base frame 20 is supported by the terminal base part, said base part having fastening ring 241 is fixed on the supporting surface 21 by using the pin 25; base frame 20 having center axis 22 to connect with the long trunk 10, said long trunk 10 is composed of many short pipes. The height of tree body can be adjustable by the number of the short pipe. There are many branches 30 connected to the long trunk 10 so as to form a structure of combinative tree.

FIG. 2 relates to the connection style of the decorative light strings with combinative tree of the present invention. The base frame 20 has the center axle 22 to support the main trunk to stand up right. Between the main trunk and base frame, the hollow short pipe 11 did not attach with branch and light string to increase the distance between this light string and support surface. The multiple branches 30 connect on the long trunk.

Figure 3:
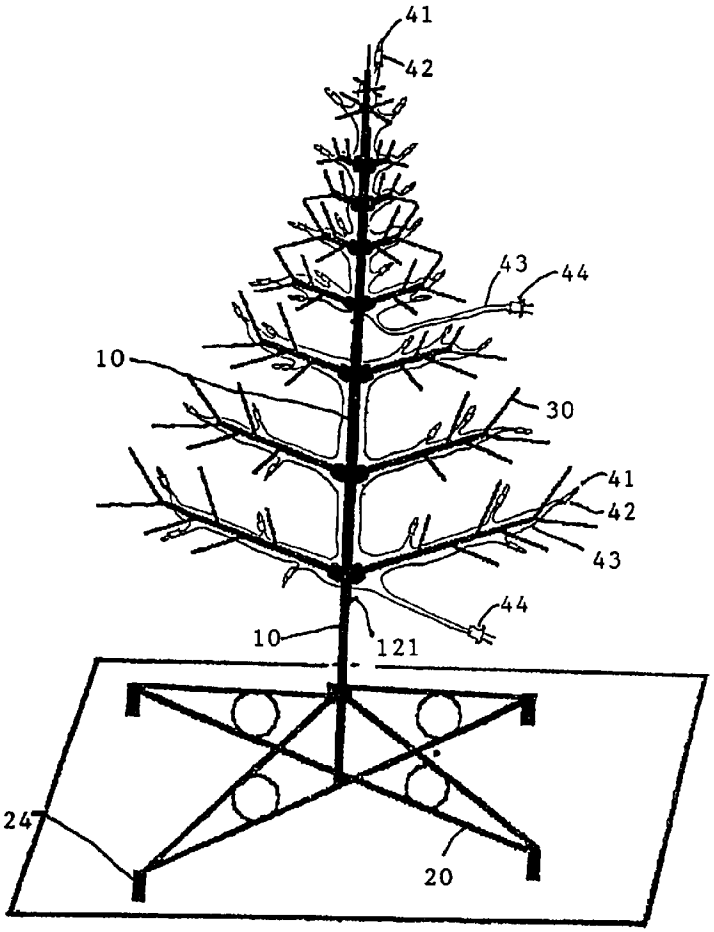
FIG. 3 is a perspective view with 3-dimention showing the practical structure of the decorative light strings with combinative tree of the present invention.

FIG. 3 is a perspective view with 3-dimention showing the practical structure of the decorative light strings with combinative tree of the present invention. The present decorative light strings with combinative tree 1 includes long trunk 10 connected by many hollow short pipes 11. Said hollow short pipe 11 has connected tenon (not shown) for easy to fix it tightly. The amount of the short pipes 11 decides the height of tree body. The base frame 20 supported on the supporting surface 21 has the center axle 22 to support the main long trunk 10 to stand up right. The multiple branches 30 connect on the long trunk 10. Single or many sets of light strings 40 are composed of many lamp bulb 41, lamp holder 42, electrical conductor 43 and receptacles 44 to be fixed on the branches 30 to establish tree light.

Figure 4:
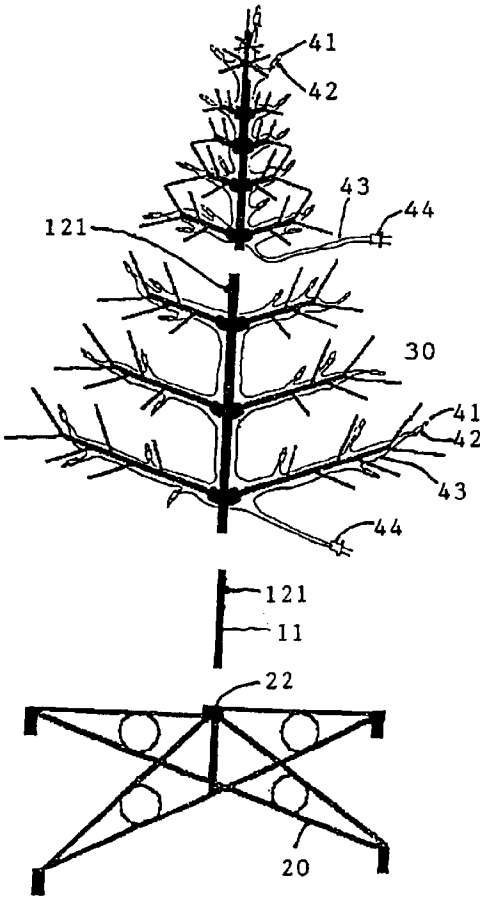
FIG. 4 is a perspective view of the preferred embodiment of the connection style of the light string of the decorative light strings with combinative tree of the present invention.

FIG. 4 relates to the connection style of the light string of the decorative light strings with combinative tree of the present invention. The base frame 20 has the center axle 22 to support the main long trunk to stand up right. Between the main long trunk and base frame, the hollow short pipe 11 did not attach with branch and light string to increase the distance between this light string and supporting surface. The multiple branches 30 connect on the long trunk.

Figure 5A:
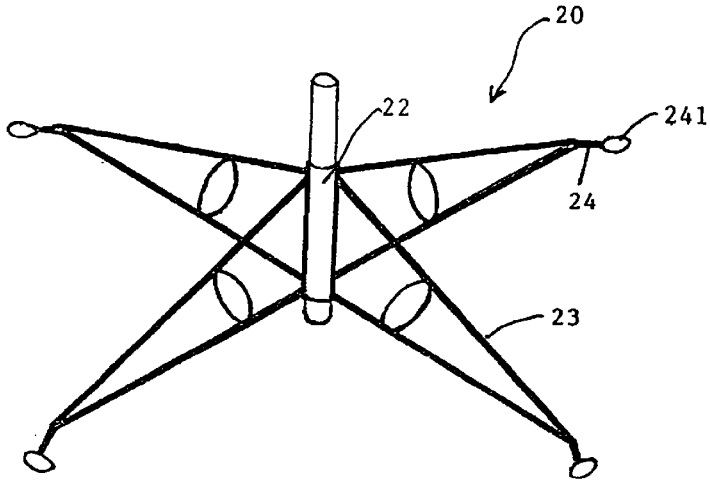
FIG. 5A is a perspective view of stretching out of the base frame of the decorative light strings with combinative tree of the present invention.

FIG. 5A is a perspective view of stretching out of the base frame of the decorative light strings with combinative tree of the present invention. The base frame 20 is composed of many branch frames 23. Said base frame is to stretch out or to fold up from the center axle 22. The terminal end of branch frame 23 has a base part 24 attached fastening ring 41. The pin via the fastening ring 241 is to nail into the support surface to fix the base frame 20.

Figure 5B:
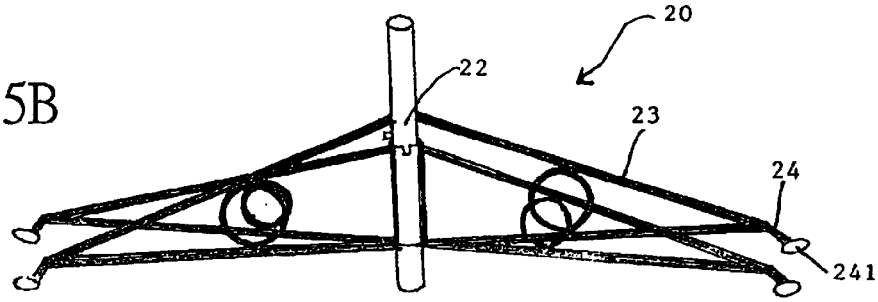
FIG. 5B is a perspective view of folding up of the base frame of the decorative light strings with combinative tree of the present invention.

FIG. 5B is a perspective view of folding up of the base frame 20 of the decorative light strings with combinative tree of the present invention. From the center axle 22, many branch frames 23 fold up together to reduce the volume. The base part 24 of branch frame is equipped at the end of many branch frames 23, and is attached with fastening ring 241 whereby to accept the pin 25.

Figure 6:
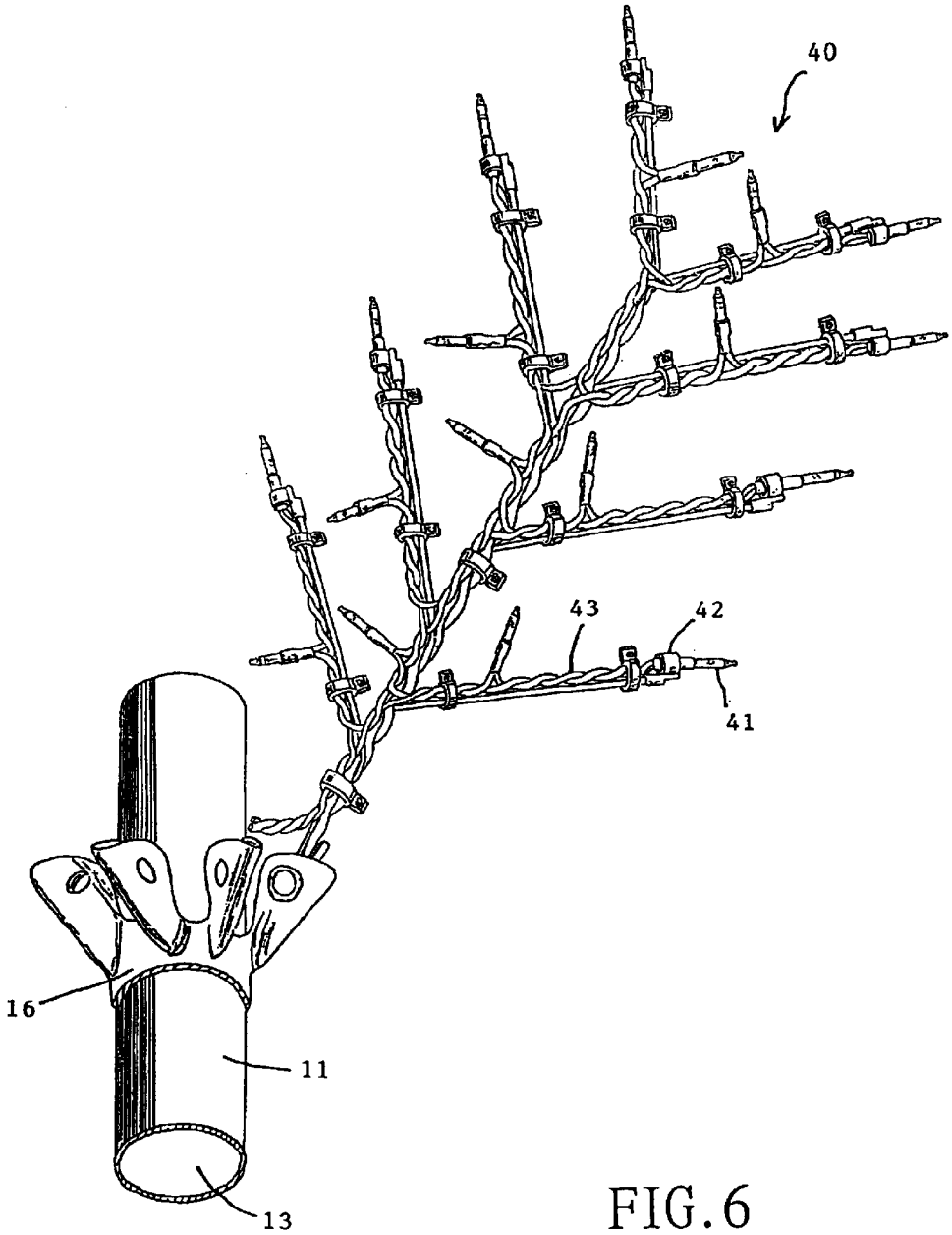
FIG. 6 is a perspective view showing the practical structure of the light string of decorative light strings with combinative tree of the present invention.

FIG. 6 is a perspective view showing the practical structure single or many sets of light string 40 of decorative light strings with combinative tree of the present invention. Said single or many sets of light string 40 are connected with many short pipes 11. The connecting ring 16 on the short pipe 11 is used to connect the branches, and light string 40 is attached on the branches with their shape. The light string 40 is composed of lamp bulb 41, lamp holder 42, electrical conductor 43 and receptacle 44.

Figure 7B:
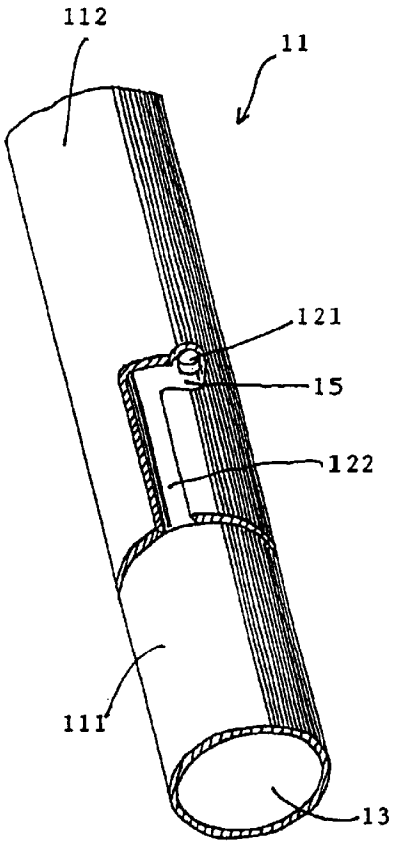
FIG. 7B is a perspective view showing the assembly of the short pipe of decorative light strings with combinative tree of the present invention.
Figure 7A:
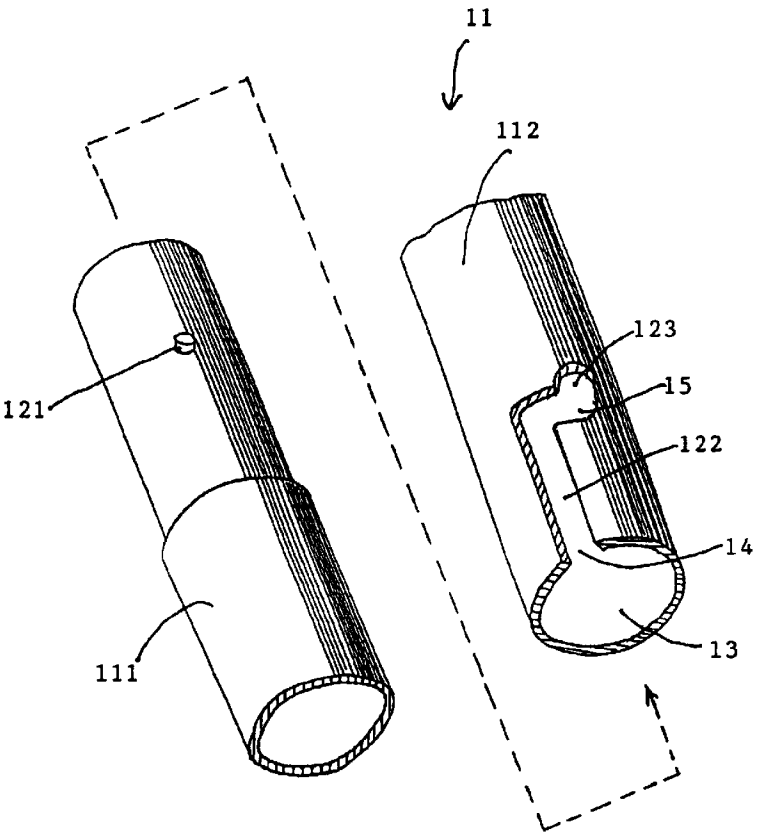
FIG. 7A is a perspective view showing the disassembly of the short pipe of decorative light strings with combinative tree of the present invention.

FIG. 7A is a perspective view showing the disassembly of the hollow short pipe 11 of decorative light strings with combinative tree of the present invention. An outer rim 111 of one end of the hollow short pipes at the predetermined distance of the open end 13 having a flange 121. An outer rim 112 of another end has a predetermined length of L-indentation 122 from the open end extending and matching the position of the flange. From the end having the flange, said flange is to aim at the open end of the L-opening 14 of another short pipe, to fit into the right position, then to rotate it to L-tail 15 and to fix it tightly.

FIG. 7B is the drawing showing the assembly of the hollow short pipe 11 of decorative light strings with combinative tree of the present invention. The hollow short pipe 11 has L-tail 15, already on the enlarged part 123 to fix the flange 121 tightly to form short pipe 11. From the foregoing it will be appreciated that although specific embodiments of the invention have been described herein for purposed of illustration, various modifications and improvements thereon will become readily apparent to those skilled in the art. Accordingly, the appended claims are to be construed broadly and in a manner consistent with the spirit and scope of the invention described herein.

While specific embodiments of the invention have been shown and described in detail to illustrate the application of the principles of the invention, it will be understood that the invention may be embodied otherwise without departing from such principles.

What is claimed is:

1. A combinative tree including:

a trunk composed of plurality of pipes including a pipe with a set of branches, the height of tree lamp being adjustable by an elongated short pipe with no branches and having a top and a bottom and a clearance for grasping starting from said top and running down to said bottom;

a base frame including a support surface to erect said base frame and having a vertical center axles to support long trunk to stand up right straight, wherein said base frame has a plurality of skeleton legs, each skeleton leg including a top branch frame and a bottom branch frame branching out from an upper and a lower portion of said center axle to meet at a single base part and said plurality of skeleton legs collapse about said center axle;

multiple branches connecting with said long trunk;

a single or multiple sets of light strings composed of many lamp bulbs, lamp holders, electrical conductors and receptacles, to be fixed on said branches to establish tree light strings.

2. A combinative tree as claimed in claim 1, wherein said long trunk being composed of many hollow short pipes are connected with each other.

3. A combinative tree as claimed in claim 2, wherein said hollow short pipes are manufactured by metal.

4. A combinative tree as claimed in claim 2, wherein each of said hollow short pipes has a tenon for the convenience to fix each said short pipe with each other or to said base frame.

5. A combinative tree as claimed in claim 4, wherein an outer rim of one end of said short pipes at the predetermined distance of an open end has a flange, another end having a predetermined length of L-indentation from said open end extending and matching the position of said flange, from said open end having said flange, said flange interacts with another open end of another L-indentation of another short pipe, to fit into another right position, then to rotate said flange to L-tail and to fix said short pipe with said another short pipe tightly.

6. A combinative tree as claimed in claim 5, wherein the base part of said L-indentation of said short pipe having an enlarged area so that said flange can be dovetailed into an enlarged area so as to prevent said tree from falling down or apart.

7. A combinative tree as claimed in claim 1, wherein said short pipes on said long trunk is provided with one or more connecting rings to connect with said many branches.

8. A combinative tree as claimed in claim 1, wherein said base frame is composed of many branch frames and is able to stretch out or to fold up from said center axle.

9. A combinative tree as claimed in claim 8, wherein a base part of said branch frame having a fastening ring and a pin being going through said fastening ring to nail into said supporting surface and to fix said base frame.

10. A combinative tree as claimed in claim 8, wherein said base frame is stretched out from said center axle and prevent said base frame from being fallen on a certain angle of said supporting surface.

11. A combinative tree as claimed in claim 8, wherein said support surface used to erect said base frame is used for indoor and out door floor.

12. A combinative tree as claimed in claim 8, wherein said support surface used to erect said base frame is used for soft and hard floors at out door.

13. A combinative tree as claimed in claim 1, wherein said hollow short pipe between a main trunk and said base frame are not attached with said branch and light string to increase the distance between this light string and said support surface.

14. A combinative tree as claimed in claim 1, wherein said light string is attached to a protection device, transformer or functional control device to increase the decorative function.

15. A combinative tree including:

a trunk composed of a plurality of pipes, the height of tree lamp can be adjusted by a short pipe with a top and a bottom and a clearance for grasping starting from said top and running down to said bottom;

an outer rim of one end of said hollow short pipes at a predetermined distance of an open end having a flange, another end having a predetermined length of L-indentation from said open end extending and matching the position of said flange, from said end having said flange, said flange interacting with an open end of said L-indentation of another short pipe, to fit into a right position, then to rotate said flange to L-tail and to fix said short pipe and another short pipe together tightly;

a base frame including a support surface to erect said base frame and to have a center axis to support long trunk to stand up right straight, wherein said base frame has a vertical center axle and a plurality of skeleton legs, each skeleton leg including a top branch frame and a bottom branch frame branching out from an upper and a lower portion of said center axle to meet at a single base part and said plurality of skeleton legs collapse about said center axis;

multiple branches connecting with said long trunk;

single or multiple sets of light strings composed of many lamp bulbs, lamp holders, electrical conductors and receptacles, to be fixed on said branches to establish tree light strings.

16. A combinative tree comprising:

a base frame on a support surface for supporting a structure along a central axis, said base frame having a vertical center axle and a plurality of skeleton legs, each skeleton leg including a top branch frame and a bottom branch frame branching out from an upper and a lower portion of said center axle to meet at a single base part, said plurality of skeleton legs collapsible about said central axis;

an elongated height-adjusting pipe with a top and a bottom connected on said base frame, said height-adjusting pipe having a top connector means near the top, a bottom connector means near the bottom, and a clearance for grasping starting from said top and running down to said bottom;

a trunk pipe with a second top and a second bottom, said trunk pipe having said top connector means near said second top and said bottom connector means near said second bottom;

a top trunk pipe with a third bottom, said top trunk pipe having said bottom connector means near said third bottom;

a plurality of branches connected to outer perimeter of said trunk pipe and said top trunk pipe; and a single or a set light strings, each light string including a lamp bulb, a lamp holder, and an electrical conductor, said single or said set of light strings including a receptacle, wherein said single or said set of light strings are fixed on said plurality of branches to establish decorative tree light illumination.

17. A combinative tree according to claim 16, wherein at least one of said top connector means and said bottom connector means has a flange at an outer rim of said pipe, the other means having a length of L-indentation with an open end, wherein said flange of said pipe is able to slide into said open end of another pipe, and said pipe has a diminished diameter to fit into the diameter of said another pipe, and flange rotates and changes direction at a corner of L-indentation and fits snugly into a tail portion of said L-indentation to fit said pipe and another pipe tightly together.

18. A combinative tree according to claim 16, wherein a table-top combinative tree is formed by eliminating at least one of said trunk pipe and said height-adjusting pipe.

19. A combinative tree according to claim 16, wherein said plurality of branches are rotatable at said outer perimeter of said pipe so that each axis of said branches can be substantially parallel to an axis of said pipe.

20. A combinative tree according to claim 16, wherein said base frame is provided with a rotatable center axle to support said pipe.

* * * * *